United States Patent [19]

Aoki et al.

[11] Patent Number: 5,022,464

[45] Date of Patent: Jun. 11, 1991

[54] CONDENSER

[75] Inventors: Hisao Aoki, Maebashi; Toru Yamaguchi, Isesaki, both of Japan

[73] Assignee: Sanden Corporation, Gunma, Japan

[21] Appl. No.: 377,251

[22] Filed: Jul. 10, 1989

[30] Foreign Application Priority Data

Jul. 9, 1988 [JP] Japan ..... 63-90503[U]

[51] Int. Cl.[5] ..... F28F 9/10; F28D 7/06

[52] U.S. Cl. ..... 165/176; 165/176

[58] Field of Search ..... 165/176, 175, 174

[56] References Cited

U.S. PATENT DOCUMENTS

| | | | |
|---|---|---|---|
| 1,869,236 | 7/1932 | Baumann | 165/176 |
| 1,897,213 | 2/1933 | Price et al. | 165/175 |
| 4,520,867 | 6/1985 | Sacca et al. | 165/176 |

FOREIGN PATENT DOCUMENTS

| | | | |
|---|---|---|---|
| 2002096 | 8/1970 | Fed. Rep. of Germany | 165/176 |
| 905959 | 12/1945 | France | 165/176 |
| 1265756 | 4/1961 | France | 165/176 |
| 58280 | 9/1912 | Switzerland | 165/176 |
| 17467 | of 1915 | United Kingdom | 165/176 |

*Primary Examiner*—John Rivell
*Assistant Examiner*—L. R. Leo
*Attorney, Agent, or Firm*—Banner, Birch, McKie & Beckett

[57] ABSTRACT

A condenser for use in an automotive air conditioning system including inlet and outlet union elements is disclosed. The condenser comprises a plurality of flat pipes for conducting refrigerant and a plurality of corrugated fins fixedly sandwiched between the flat pipes. First and second header pipes are fixedly and hermetically connected to the flat pipes, thereby communicatingly connecting the flat pipes to the interior of the header pipes. Inlet and outlet union elements for connecting the condenser to the other elements of the air conditioning system are formed in one body and connected to one of the first and second header pipes, thereby reducing the fraction of union element/header pipe junctions which are defective by reducing the number of union element/header pipe junctions.

15 Claims, 5 Drawing Sheets

CONDENSER

BACKGROUND OF THE INVENTION

1. Field of the Invention

The present invention generally relates to a heat exchanger, more particularly, to a condenser suitable for use in an automotive air conditioning system.

2. Description of the Prior Art

Japanese Utility Model Application Publication No. 58-104867 discloses a condenser suitable for use in an automotive air conditioning system. With reference to FIG. 1 of this first prior art device, the condenser includes serpentine-shaped flat pipe 110 for conducting a refrigerant therethrough. Serpentined flat pipe 110 comprises a plurality of straight portions 110*a* located parallel to each other. Straight portions 110*a* fixedly sandwich corrugated fins 111 therebetween. Inlet and outlet unions 112 and 113 are fixedly and hermetically connected at both open ends of serpentined flat pipe 110 respectively.

In this first prior art device, reduction of the gap H' between straight portions 110*a* is restricted because the flat pipe 110 must be bent into the serpentine shape, thereby limiting to elevation of heat radiating efficiency of fin 111. Further, a high flow resistance is encountered when the refrigerant flows through flat pipe 110, because the refrigerant must flow through each straight position 110*a* in series from the inlet to the exit union. Finally, this structure is thereby limited by the gap H', i.e., distance between flat pipes and is further limited by the heat radiating efficiency of fins 111.

To overcome the above-mentioned defects, Japanese Patent Application Publication No. 63-112065 discloses a second prior art device. With reference to FIG. 2, the condenser includes a plurality of flat pipes 120 of aluminum alloy located parallel to each other. Each flat pipe 120 conducts refrigerant therethrough. Flat pipes 120 fixedly sandwich corrugated fins 121 of clad aluminum alloy therebetween.

First header pipe 122 having an open end and a closed end is mounted perpendicular to flat pipes 120 and is fixedly and hermetically connected to one end of each flat pipe 120. Inlet union 122*a* is fixedly and hermetically connected to the open end of first header pipe 122. Second header pipe 123, also having an open end and a closed end, is mounted perpendicular to flat pipes 120 and is fixedly and hermetically connected to the other end of each flat pipe 120. Outlet union 123*a* is fixedly and hermetically connected to the open end of second header pipe 123.

In the construction of the second prior art device, the refrigerant in first header pipe 122 first flows into inlet union 122*a*, then distributively flows into each flat pipe 120, and sequentially flows together into second header pipe 123, so that the flow resistance generated as the refrigerant flows through flat pipe 120 is remarkably less than the flow resistance in the first prior art device. Accordingly, the diameter of the flat pipes 120 can be reduced without generating high flow resistance. Consequently, the number of flat pipes 120 can be increased without increasing the size of the condenser, that is, the gap H in the second prior art device is less than the gap H' in the first prior art device. As a result, a condenser having a greater ability to exchange heat is obtained.

In the second prior art device, inlet and outlet unions 122*a*, 123*a* are fixedly and hermetically connected to each open end of first and second header pipes 122 and 123 respectively, for example, by brazing. That is, two hermetically joined portions between the union and the header pipe exist.

However, it is desirable to provide only one union element to the header pipes, because the number of potentially defective hermetically joined portions is proportional to the number of hermetically joined portions.

SUMMARY OF THE INVENTION

Accordingly, it is an object of the present invention to reduce the fraction of defective union element/-header pipe junctions by reducing the number of union element/header pipe junctions.

It is another object of the present invention to reduce the number of parts of the condenser, thereby decreasing the manufacturing cost.

The present invention is directed toward providing these objectives with a condenser which preferably includes a plurality of flat metal tubes for conducting fluid having opposite first and second ends respectively. A plurality of metal fins are sandwiched by the flat metal tubes. First and second header pipes, which are closed at both ends respectively, are fixedly and hermetically mounted on the opposite ends of the flat metal tubes respectively, so that the flat metal tubes communicate with the interior of each header pipe. An inlet union element hermetically connects the condenser to an upstream element with respect to the condenser, for example, a compressor. An outlet union element hermetically connects the condenser to a downstream element with respect to the condenser, for example, a receiver drier. A member including the inlet and outlet union elements in one body is preferably fixedly and hermetically connected to the longitudinal center of one of the first and second header pipes.

BRIEF DESCRIPTION OF THE DRAWINGS

A more complete appreciation of the present invention and many of the attendant advantages thereof will be readily obtained as the invention becomes better understood from the following detailed description with reference to the attached drawings.

DETAILED DESCRIPTION OF THE PREFERRED EMBODIMENT

Figure 1:
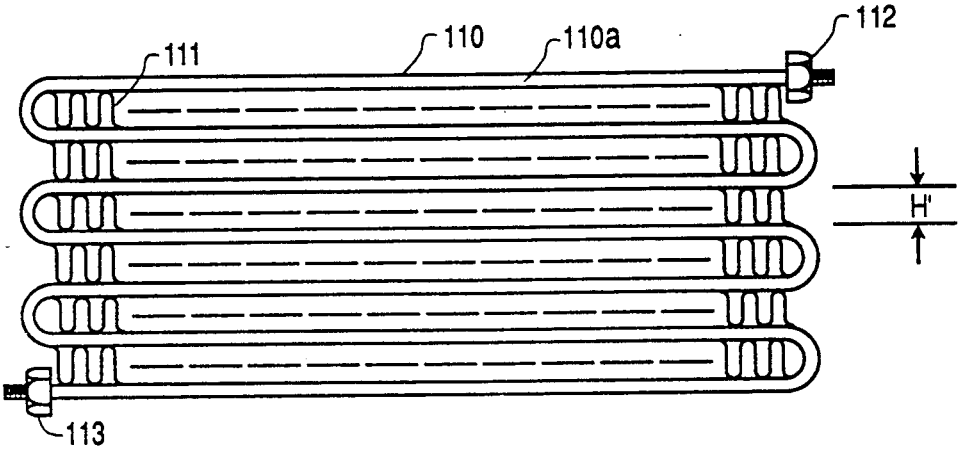
FIG. 1 PRIOR ART
FIG. 1 is a front elevation view of a condenser in accordance with the first prior art device.
Figure 2:
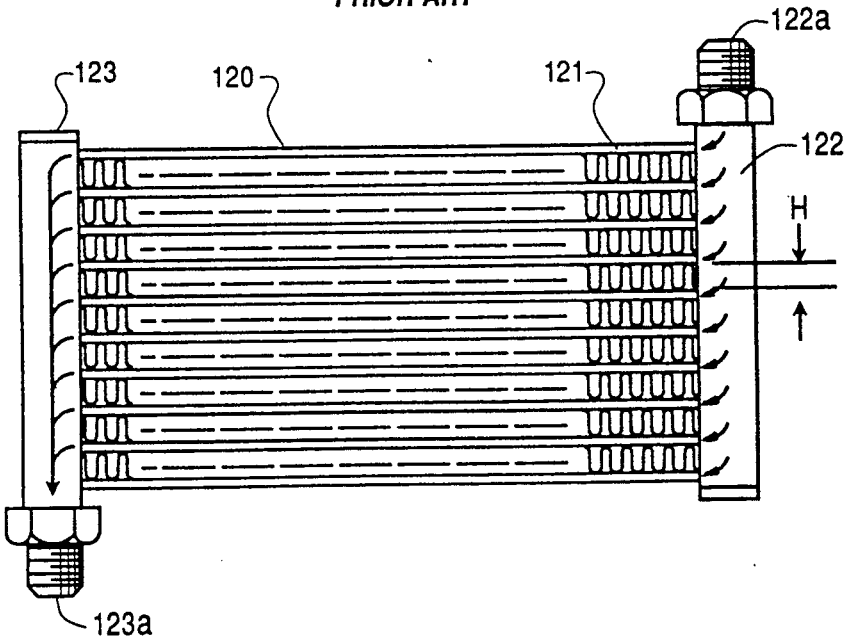
FIG. 2 PRIOR ART
FIG. 2 is a front elevation view of a condenser in accordance with the second prior art device.
Figure 3:
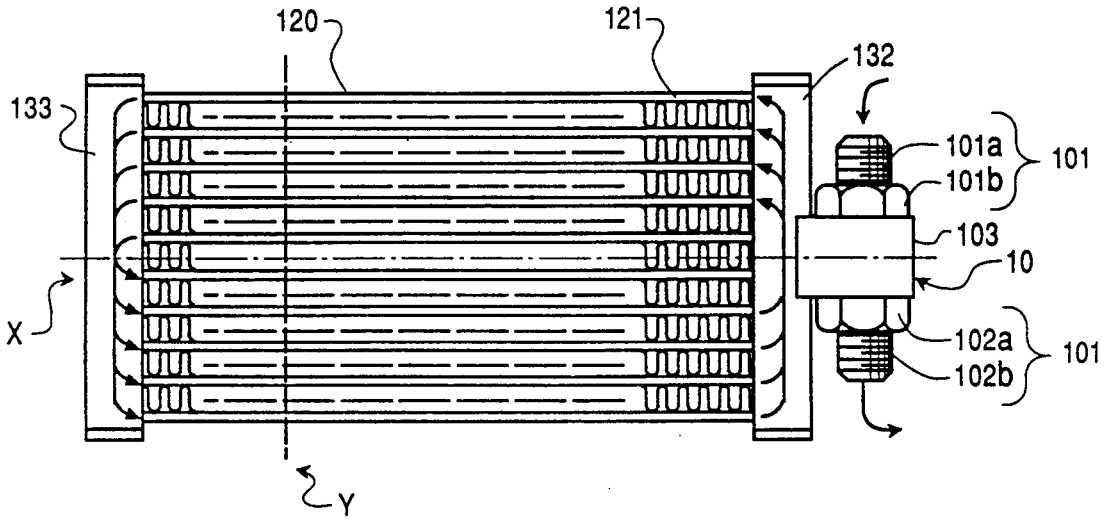
FIG. 3 is a front elevation view of a condenser in accordance with the preferred embodiment of the present invention.

A condenser in accordance with the preferred embodiment of the present invention is shown in FIG. 3. In the drawing, the same numerals are used to denote the corresponding elements shown in FIG. 2 and in such cases an explanation thereof is omitted.

First header pipe 132, having both ends closed, is made of clad aluminum alloy. First header pipe 132 is mounted perpendicular to flat pipes 120 and is fixedly and hermetically connected to one end of each flat pipe 120 by brazing. Second header pipe 133 has both ends closed and is made of a clad aluminum alloy. Second header pipe 133 is also mounted perpendicular to each flat pipe 120 and is fixedly and hermetically connected to the other end of each flat pipe 120 by brazing. The horizontal axis X of the condenser is preferably parallel to the longitudinal axes of the flat pipes 120. The vertical axis Y of the condenser is preferably parallel to the longitudinal axes of the header pipes 132, 133 and preferably perpendicular to the longitudinal axes of the flat pipes 120.

Figure 4:
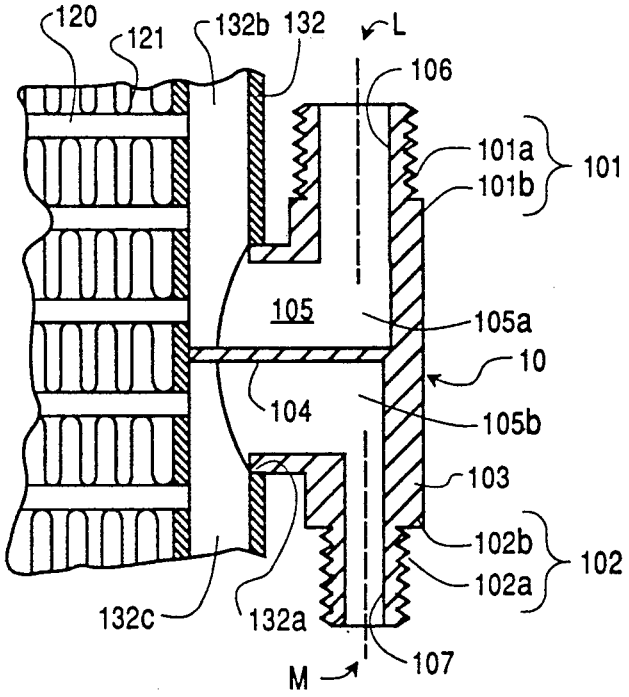
FIG. 4 is an enlarged fragmentary vertical sectional view of the condenser shown in FIG. 3.

Referring to FIG. 4, the preferred union element 10 comprises inlet portion 101 having a longitudinal axis L, outlet portion 102 having a longitudinal axis M, and main body portion 103 which are integrally formed together. Main body portion 103 is aligned perpendicularly to first header pipe 132 and is fixedly and hermetically connected by brazing to the edge of opening 132*a*, which is in the longitudinally central portion of first header pipe 132. Inlet and outlet portions 101, 102 are located opposite to each other and both are aligned parallel to first header pipe 132.

Each of inlet and outlet portions 101, 102 includes a hexagonal nut portions 101*b*, 102*b* respectively, formed at the basal part thereof and outside threaded portions 101*a*, 102*a* respectively, formed at a remainder thereof.

Large cavity 105, which is communicatingly connected to the interior of first header pipe 132 through opening 132*a*, is formed in main body portion 103. Holes 106, 107 extending from cavity 105 are axially bored through inlet and outlet portions 101, 102 respectively and are open at each axial end of inlet and outlet portions 101, 102.

Wall 104 partitions cavity 105 into first cavity 105*a* from which hole 106 extends and second cavity 105*b* from which hole 107 extends. Wall 104 further projects toward an inner arcuate surface (to the left in FIG. 4) of first header pipe 132, and is hermetically connected thereto by brazing, thereby hermetically dividing the inside space of first header pipe 132 into upper space portion 132*b* and lower space portion 132*c*. Accordingly, first and second cavities 105*a*, 105*b* are hermetically linked to upper and lower space portions 132*b*, 132*c* respectively.

In the above construction, when the automotive air conditioning system is operated, refrigerant gas from a compressor (not shown) flows into hole 106 through a pipe member (not shown). Consequently, the refrigerant gas distributively flows through each flat pipe 120 located in the upper half portion of the condenser via first cavity 105*a* and upper space portion 132*b*, then flows together in second header pipe 133. When the refrigerant gas flows through flat pipes 120 located in the upper half portion of the condenser, the refrigerant gas exchanges heat with the air outside the condenser. That is, it radiates heat to the outside air and is condensed.

Refrigerant flowing together in second header pipe 133 then distributively flows from each flat pipe 120 located in the lower half portion of the condenser. With heat exchanging causing the refrigerant to be liquefied, consequently, the refrigerant flows out to a receiver drier (not shown) through a pipe member (not shown) via lower portion 132*c*, second cavity 105*b* and hole 107.

Figure 5:
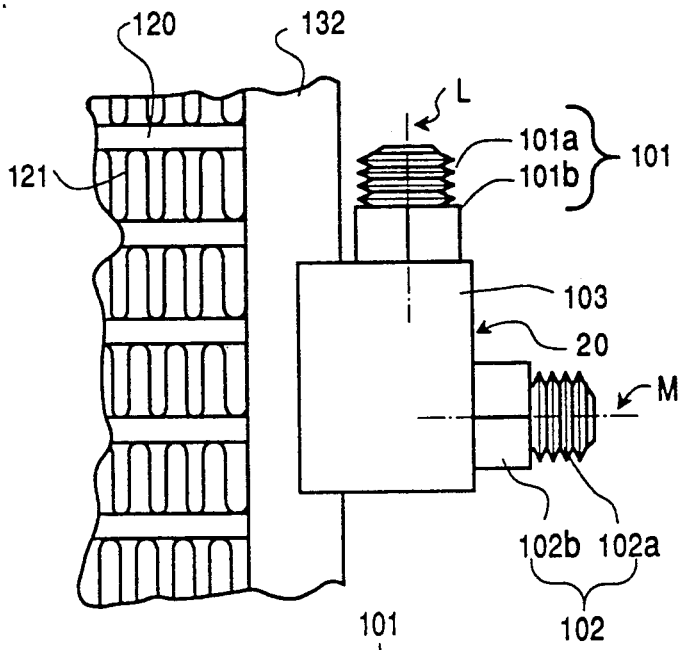
FIG. 5 is a front elevation view of an essential part of a condenser in accordance with a second embodiment of the present invention.
Figure 6:
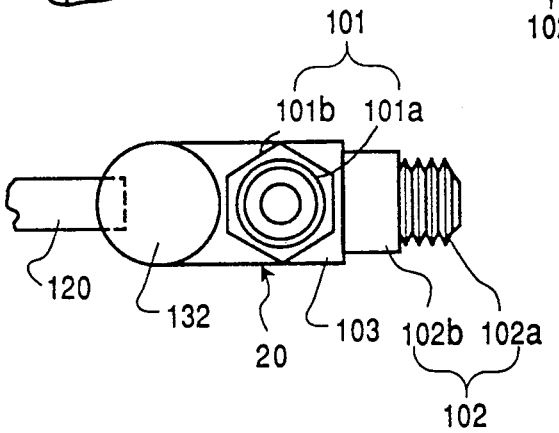
FIG. 6 is a plan view of the essential part of the condenser shown in FIG. 5.
Figure 7:
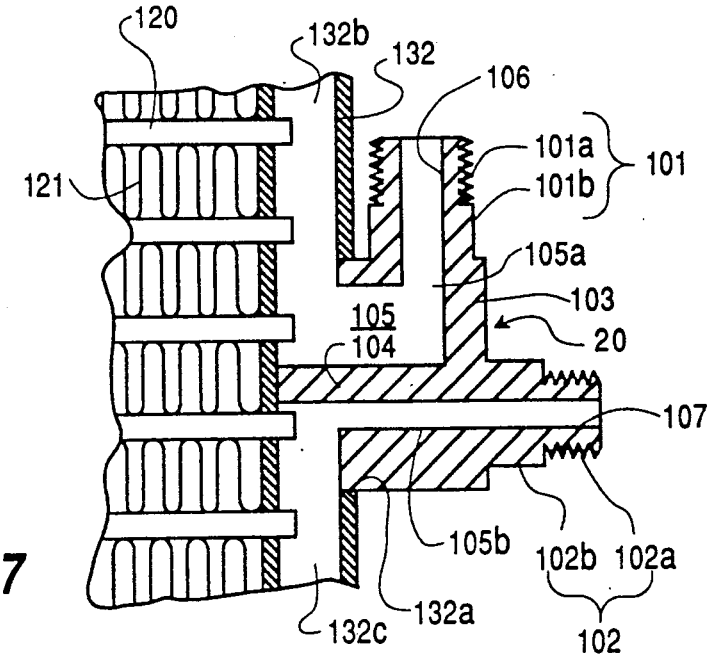
FIG. 7 is a vertical sectional view of the essential part of the condenser shown in FIG. 5.
Figure 8:
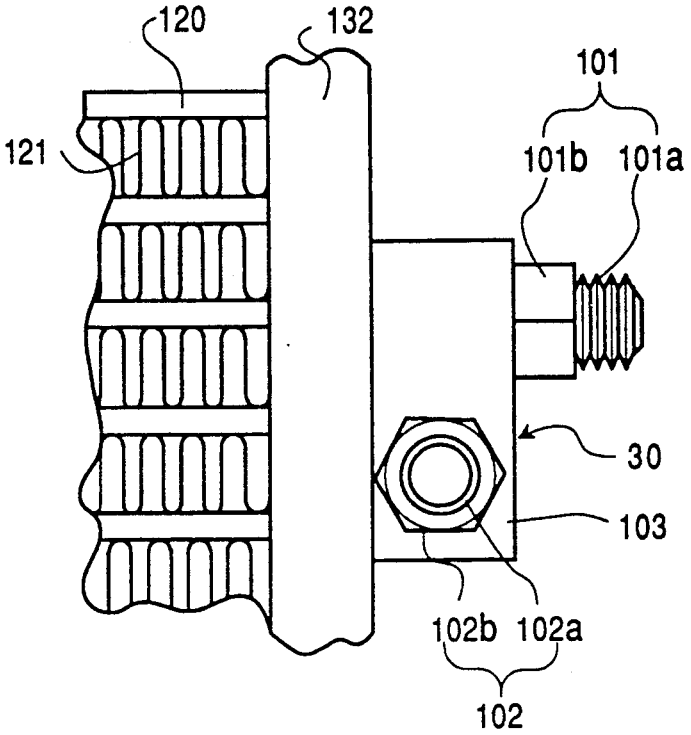
FIG. 8 is a front elevation view of an essential part of a condenser in accordance with a third embodiment of the present invention.
Figure 9:
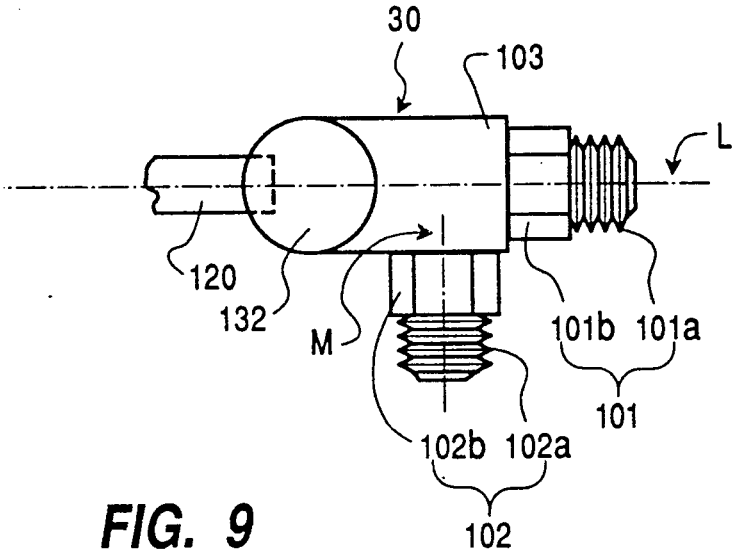
FIG. 9 is a plan view of the essential part of the condenser shown in FIG. 8.
Figure 10:
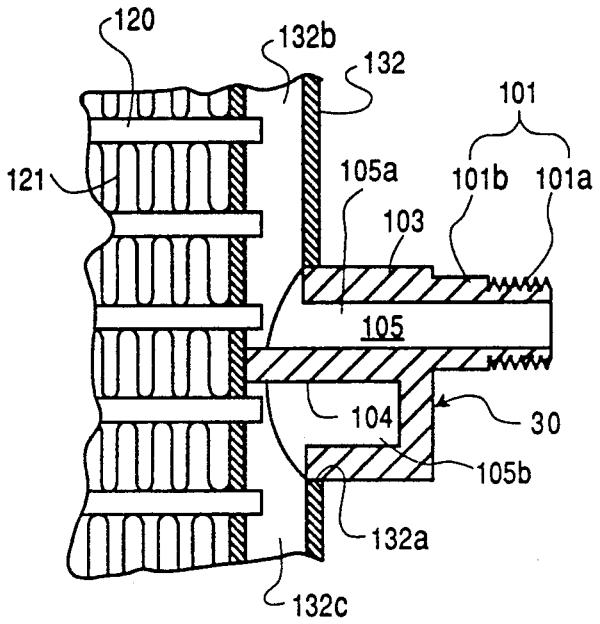
FIG. 10 is a vertical sectional view of the essential part of the condenser shown in FIG. 8.
Figure 11:
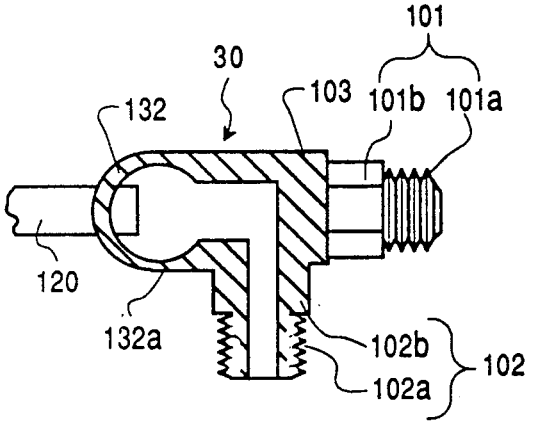
FIG. 11 is a transverse sectional view of the essential part of the condenser shown in FIG. 8.

FIGS. 5, 6 and 7 illustrate a second embodiment of the present invention. In this embodiment, inlet portion 101 having longitudinal axis L is aligned parallel to first header pipe 132. Outlet portion 102 having longitudinal axis M is perpendicular to inlet portion 101 and is opposite to flat pipe 120.

FIGS. 8, 9, 10 and 11 illustrate a third embodiment of the present invention. In this embodiment, inlet portion 101 having longitudinal axis L is opposite to flat pipe 120. Outlet portion 102 having a longitudinal axis M is perpendicular to both inlet portion 101 and first header pipe 132.

The position of each inlet and outlet portion 101, 102 is not restricted to the above-mentioned embodiments. Other varied positions for each inlet and outlet portion 101, 102 can still fall within the scope of the claimed invention.

Figure 12:
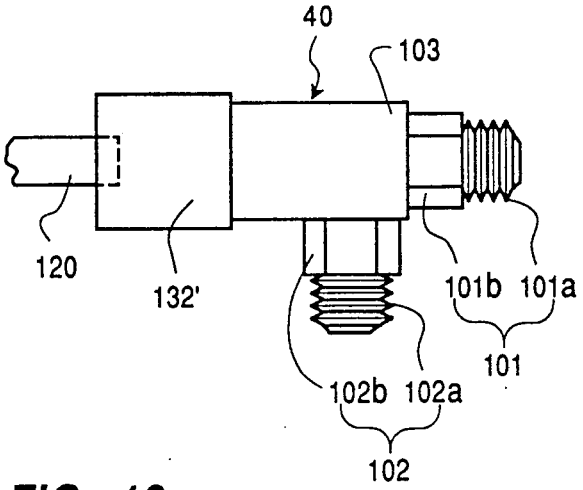
FIG. 12 is a plan view of an essential part of a condenser in accordance with a fourth embodiment of the present invention.

FIG. 12 illustrates a fourth embodiment of the present invention. In this embodiment, first header pipe 132' is square, while the first header pipe in the first, second and third embodiments of the present invention is round.

This invention has been described in detail in connection with the preferred embodiment and alternative embodiments. These embodiments, however, are merely for example only and the invention is not restricted thereto. It will be understood by those skilled in the art that other variations and modifications can easily be made within the scope of this invention as defined by the claims.

We claim:

1. In a condenser for conducting a fluid comprising a plurality of flat tubes having opposite first and second ends respectively, a plurality of fins sandwiched by said flat tubes, first and second header pipes each being closed at both ends and fixed and hermetically mounted to one of said opposite ends of each of said flat tubes, whereby said flat tubes communicate with the interior of said header pipes, an inlet union element for hermetically connecting said condenser to an upstream element with respect to said condenser, an outlet union element for hermetically connecting said condenser to a downstream element with respect to said condenser, an improvement comprising:

a union member including a body having a single cavity divided by a plate to define said inlet and outlet union elements, wherein said union member body is fixedly and hermetically connected to the longitudinal center of one of said first and second header pipes and said main body permits fluid to flow into and out of said condenser from a single opening located on one of said header pipes.

2. In a condenser comprising a plurality of flat tubes, a first and a second header pipe wherein each of said header pipes is connected to one end of each of said flat tubes and communicates with the interior of each of said flat tubes, a plurality of fin sets, wherein each of said fin sets is sandwiched between two adjacent flat tubes respectively, an improvement comprising:

means for permitting a refrigerant to flow into and out of said condenser, wherein said permitting means includes:

a main body portion having a single cavity operatively connected to a single opening in a surface of one of said first and second header pipes;

an inlet portion for hermetically connecting said condenser to an upstream element with respect to a condenser; and an outlet portion for hermetically connecting said condenser to a downstream element with respect to the condenser;

wherein both of said inlet and outlet portions are in fluid communication with said single cavity of said main body.

3. The improvement according to claim 2, wherein said condenser comprises a partitioning wall that contacts one of said header pipes at one end and said main body portion at the other end to separate said inlet union element from said outlet union element.

4. In a condenser comprising a horizontal axis and a vertical axis, a plurality of flat metal tubes lying substantially along said horizontal axis, a first and a second header pipe, wherein each of said header pipes is connected to one end of each of said flat metal tubes and communicates with the interior of each of said flat metal tubes respectively, a plurality of metal fin sets, wherein each of said fin sets is sandwiched between two adjacent flat metal tubes respectively, an improvement comprising:

means for permitting a fluid to flow into and out of said condenser, wherein said permitting means includes:

a main body portion having a single cavity operatively connected to a single opening in a surface of one of said first and second header pipes;

an inlet portion for hermetically connecting said condenser to an upstream element with respect to a condenser; and an outlet portion for hermetically connecting said condenser to a downstream element with respect to the condenser;

wherein both of said inlet and outlet portions are in fluid communication with said single cavity of said main body.

5. The improvement according to claim 4, wherein longitudinal axes of said inlet and said outlet union elements are substantially parallel to said vertical axis.

6. The improvement according to claim 4, wherein the longitudinal axis of said inlet union element is substantially parallel to said vertical axis and the longitudinal axis of said outlet union element is substantially perpendicular to said vertical axis.

7. The improvement according to claim 4, wherein the longitudinal axes of said inlet and said outlet union elements are substantially perpendicular to said vertical axis.

8. In a condenser comprising a vertical axis and a horizontal axis, a plurality of flat metal tubes lying substantially along said horizontal axis, a first and a second header pipe, wherein each of said header pipes is connected to one end of each of said flat metal tubes respectively, a plurality of metal fin sets, wherein each of said sets is sandwiched between two adjacent flat metal tubes respectively, an improvement comprising:

a main body having a single cavity divided by a plate to define an inlet union element having a longitudinal axis and an outlet union element having a longitudinal axis, and wherein said main body permits refrigerant to flow into and out of said condenser from a single opening located on one of said header pipes, wherein the longitudinal axes of said inlet and said outlet union elements are substantially parallel to said vertical axis of said condenser.

9. In a condenser comprising a vertical axis and a horizontal axis, a plurality of flat metal tubes lying substantially along said horizontal axis, a first and a second header pipe, wherein each of said header pipes are connected to one end of each of said flat metal tubes respectively, a plurality of metal fin sets, wherein each of said sets is sandwiched between two adjacent flat metal tubes respectively, an improvement comprising:

a main body having a single cavity divided by a plate to define an inlet union element having a longitudinal axis and an outlet union element having a longitudinal axis, and wherein said main body permits refrigerant to flow into and out of said condenser from a single opening located on one of said header pipes, wherein the longitudinal axis of said inlet union element is substantially parallel to said vertical axis of said condenser and the longitudinal axis of said outlet union element is substantially perpendicular to said vertical axis of said condenser.

10. In a condenser comprising a first header pipe having at least one closed end, a second header pipe having at least one closed end, at least one tube connected to and communicating with each of said header pipes, and at least one fin set operatively connected to said at least one tube, an improvement comprising:

means operatively connected to said first header pipe for permitting a fluid to flow into and out of said condenser from a single opening on one of said header pipes, and wherein said means includes a main body having a single cavity divided by a plate to define an inlet portion having a longitudinal axis and an outlet portion having a longitudinal axis, and wherein said condenser has a vertical axis and a horizontal axis, and the longitudinal axes of said inlet and outlet portions are substantially parallel to said vertical axis of said condenser.

11. In a condenser comprising a first header pipe having at least one closed end, a second header pipe having at least one closed end, at least one tube connected to and communicating with each of said header pipes, and at least one fin set operatively connected to said at least one tube, an improvement comprising:

means operatively connected to said first header pipe for permitting a fluid to flow into and out of said condenser from a single opening on one of said header pipes, and wherein said means includes a main body having a single cavity divided by a plate to define an inlet portion having a longitudinal axis and an outlet portion having a longitudinal axis, and wherein said condenser has a vertical axis and a horizontal axis, the longitudinal axis of said inlet portion is substantially parallel to said vertical axis of said condenser and the longitudinal axis of said outlet portion is substantially perpendicular to said vertical axis of said condenser.

12. The improvement according to claim 2, wherein said first header pipe has a circular cross-section.

13. The improvement according to claim 2, wherein said first header pipe has a square cross-section.

14. The improvement according to claim 8, wherein said inlet and outlet union elements project from said main body.

15. The improvement according to claim 9, wherein said inlet and outlet union elements project from said main body.

* * * * *